US010399111B2

(12) United States Patent
Shiba et al.

(10) Patent No.: US 10,399,111 B2
(45) Date of Patent: Sep. 3, 2019

(54) COATING METHOD, COATING DEVICE, AND FUNCTIONAL FILM PRODUCTION METHOD

(71) Applicant: Sumitomo Chemical Company, Limited, Tokyo (JP)

(72) Inventors: Ryutaro Shiba, Niihama (JP); Yasutoshi Minemoto, Niihama (JP)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/279,882

(22) Filed: Sep. 29, 2016

(65) Prior Publication Data

US 2017/0095830 A1 Apr. 6, 2017

(30) Foreign Application Priority Data

Oct. 2, 2015 (JP) ..... 2015-197123
Sep. 27, 2016 (JP) ..... 2016-188320

(51) Int. Cl.
*B05D 1/28* (2006.01)
*B05C 1/08* (2006.01)

(52) U.S. Cl.
CPC ..... *B05C 1/0856* (2013.01); *B05C 1/0808* (2013.01); *B05D 1/28* (2013.01); *B05C 1/0826* (2013.01)

(58) Field of Classification Search
CPC ..... B05D 1/28
See application file for complete search history.

(56) References Cited

U.S. PATENT DOCUMENTS 5,688,523 A * 11/1997 Garbe ..... A61K 9/7053 424/448
2005/0152034 A1* 7/2005 Matsunaga ..... G02B 1/111 359/488.01
2009/0246614 A1* 10/2009 Kim ..... H01M 2/145 429/145
2014/0057057 A1* 2/2014 Terai ..... H01M 2/145 427/535
2014/0170464 A1* 6/2014 Iwase ..... H01M 2/166 429/144

FOREIGN PATENT DOCUMENTS

JP 2006297829 A 11/2006

OTHER PUBLICATIONS

Asodekar et al "An Overview of Process Parameters of Micro Gravure Coater to Improve the Quality of Wet Coating" IJMET, V5, Iss4, Apr. (2014) p. 96-102 (Year: 2014).*
Hwang et al ("A Development and Evaluation of Micro-gravure coater for printer electronics" Japanese Journal of Applied Physics 53 (2014) 05HC12-1-4, published online Apr. 28 2014 (Year: 2014).*
Webcapture of www.endmemo.com/physics/rpmlinear.php taken Dec. 27, 2018 1 pg (Year: 2018).*

* cited by examiner

*Primary Examiner* — Nathan H Empie
(74) *Attorney, Agent, or Firm* — Panitch Schwarze Belisario & Nadel LLP

(57) ABSTRACT

A film is uniformly coated with a coating solution. The following formula is satisfied:

$$0<a\times c/b<113$$

where (i) a is a diameter (mm) of a gravure roll, (ii) b is a ratio of a circumferential velocity of the gravure roll to a conveyance speed at which the film is conveyed, and (iii) c is a volume (mL/m$^2$) of recesses of the (Continued)

gravure roll, which volume is measured per unit area of a circumferential surface of the gravure roll.

7 Claims, 9 Drawing Sheets

FIG. 6
(a)
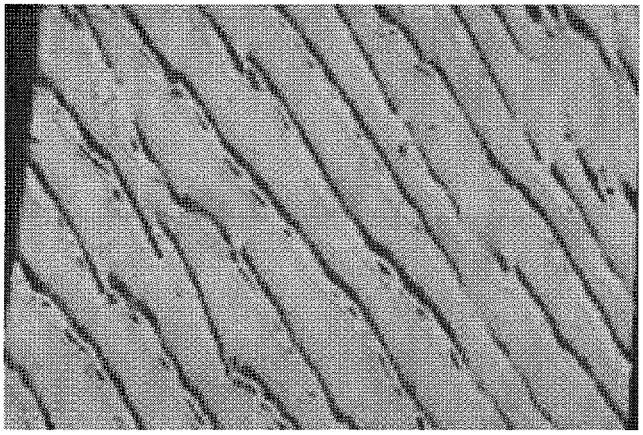
(b)
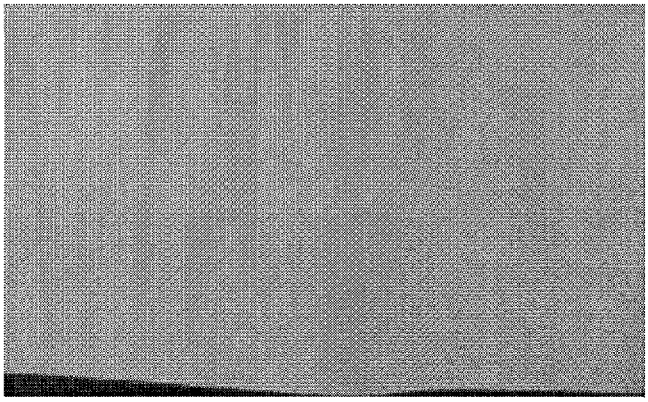

FIG. 7

(a)

| | ROLL DIAMETER (a) [mm] | ROTATION RATIO (b) [%] | LINE SPEED (d) [m/min] | VOLUME (c) [mL/m$^2$] | INDEX A (ac/b) | APPEARANCE SCORE |
|---|---|---|---|---|---|---|
| EXAMPLE 1 | 50 | 60 | 30 | 100 | 83 | 1 |
| EXAMPLE 2 | 50 | 80 | 30 | 100 | 63 | 2 |
| EXAMPLE 3 | 50 | 150 | 30 | 100 | 33 | 2 |
| EXAMPLE 4 | 80 | 80 | 60 | 60 | 60 | 2 |
| EXAMPLE 5 | 80 | 100 | 60 | 60 | 48 | 2 |
| EXAMPLE 6 | 80 | 150 | 60 | 60 | 32 | 2 |
| EXAMPLE 7 | 150 | 100 | 30 | 60 | 90 | 1 |
| EXAMPLE 8 | 150 | 120 | 30 | 60 | 75 | 1 |
| EXAMPLE 9 | 150 | 200 | 30 | 30 | 23 | 1 |
| EXAMPLE 10 | 150 | 250 | 30 | 60 | 36 | 2 |
| COMPARATIVE EXAMPLE 1 | 50 | 40 | 30 | 100 | 125 | 0 |
| COMPARATIVE EXAMPLE 2 | 150 | 80 | 30 | 60 | 113 | 0 |
| COMPARATIVE EXAMPLE 3 | 80 | 70 | 30 | 100 | 114 | 0 |

(b)

| | WEIGHT PER UNIT AREA 1 [g/m$^2$] | WEIGHT PER UNIT AREA 2 [g/m$^2$] | WEIGHT PER UNIT AREA 3 [g/m$^2$] | STANDARD DEVIATION OF WEIGHT PER UNIT AREA |
|---|---|---|---|---|
| EXAMPLE 4 | 5.42 | 5.48 | 5.55 | 0.06 |
| EXAMPLE 5 | 7.16 | 7.20 | 7.28 | 0.06 |
| EXAMPLE 6 | 7.61 | 7.64 | 7.67 | 0.03 |
| EXAMPLE 9 | 2.52 | 2.86 | 3.00 | 0.25 |
| EXAMPLE 10 | 5.36 | 5.48 | 5.64 | 0.14 |
| COMPARATIVE EXAMPLE 2 | 7.72 | 7.75 | 7.44 | 0.30 |

COATING METHOD, COATING DEVICE, AND FUNCTIONAL FILM PRODUCTION METHOD

This Nonprovisional application claims priority under 35 U.S.C. § 119 on Patent Application No. 2015-197123 filed in Japan on Oct. 2, 2015, and on Patent Application No. 2016-188320 filed in Japan on Sep. 27, 2016, the entire contents of which are hereby incorporated by reference.

TECHNICAL FIELD

The present invention relates to a coating method, a coating device, and a method of producing a functional film.

BACKGROUND ART

There are known methods for coating, with a coating solution, a surface of a film serving as a base material. Examples of the methods encompass a spin coating method, a spray coating method, a bar coating method, and a gravure coating method. The gravure coating method is carried out by (i) immersing, in a coating solution, a gravure roll having a surface on which unevenness is provided and (ii) causing the gravure roll to come into contact with a base material, so that the base material is coated with the coating solution collected in recesses. The gravure coating method is used for, for example, a step of forming a heat-resistant layer on a porous film base material during the process of producing a heat-resistant separator for a battery.

Patent Literature 1 discloses a method of producing a laminated thermoplastic resin film under certain conditions. With the method, it is possible to prevent a continuous dot-like coating stripe flaw from occurring as a result of fine flaws being connected to each other, which fine flaws are (i) formed on a surface of a film after the surface is coated with a coating solution and (ii) each formed by a resin component spreading in the form of a lower part of a mountain from an aggregate of particles contained in the coating solution.

CITATION LIST

Patent Literature

[Patent Literature 1]
Japanese Patent Application Publication Tokukai No. 2006-297829 (Publication date: Nov. 2, 2006)

SUMMARY OF INVENTION

Technical Problem

However, in some cases, depending on coating conditions, a coating solution is applied so as to be non-uniform in thickness as a result of being applied to have a pattern corresponding to the shape of recesses of a surface of a gravure roll. Furthermore, in some cases, not an entire surface of a film is coated with a coating solution, so that the surface of the film ends up being exposed.

The present invention has been made in view of the problem, and it is an object in accordance with an embodiment of the present invention to provide a coating method, a coating device, and a functional film production method, each of which is intended for uniformly coating an entire surface of a film with a coating solution.

Solution to Problem

In order to attain the object, a coating method in accordance with an embodiment of the present invention is a reverse gravure coating method of coating a film by use of a gravure roll, in which the following formula is satisfied:

$$0<a\times c/b<113$$

where (i) a is a diameter (mm) of the gravure roll, (ii) b is a ratio of a circumferential velocity of the gravure roll to a conveyance speed at which the film is conveyed, and (iii) c is a volume (mL/m$^2$) of recesses of the gravure roll, which volume is measured per unit area of a circumferential surface of the gravure roll (hereinafter, "b" may be referred to as "rotation ratio").

In order to attain the object, a coating device in accordance with an embodiment of the present invention includes: a gravure roll which rotates in a reverse direction which is opposite a direction in which a film is conveyed, the following formula being satisfied:

$$0<a\times c/b<113$$

where (i) a is a diameter (mm) of the gravure roll, (ii) b is a ratio of a circumferential velocity of the gravure roll to a conveyance speed at which the film is conveyed, and (iii) c is a volume (mL/m$^2$) of recesses of the gravure roll, which volume is measured per unit area of a circumferential surface of the gravure roll.

In order to attain the object, a functional film production method in accordance with an embodiment of the present invention is configured so that the above coating method is used.

Advantageous Effects of Invention

With an embodiment of the present invention, it is possible to provide a coating method, a coating device, and a functional film production method, each of which is intended for uniformly coating an entire surface of a film with a coating solution.

BRIEF DESCRIPTION OF DRAWINGS

FIG. 6 is a set of views (a) and (b). (a) of FIG. 6 is a photograph showing a surface of a heat-resistant layer in a case where the surface has been coated at a rotation ratio of 70% with the use of a gravure roll having a diameter of 150 mm. (b) of FIG. 6 is a photograph showing a surface of a heat-resistant layer in a case where the surface has been coated at a rotation ratio of 70% with the use of a gravure roll having a diameter of 50 mm.

FIG. 7 is set of views (a) and (b). (a) of FIG. 7 is a table showing (i) coating conditions of Examples 1 through 10 and Comparative Examples 1 through 3 under which the production method was carried out and (ii) corresponding states of appearances of heat-resistant separators obtained. (b) of FIG. 7 is a table showing weights per unit area of heat-resistant layers 4 of the heat-resistant separators obtained in Examples 4 through 6, Examples 9 through 10, and Comparative Examples 1 through 3 under which the production method was carried out.

DESCRIPTION OF EMBODIMENTS

The following description will discuss the details of an embodiment of the present invention with reference to FIGS. 1 through 9. As an example of the functional film in accordance with an embodiment of the present invention, a heat-resistant separator for a battery such as a lithium ion secondary battery will be discussed in the following description. As a coating method in accordance with an embodiment of the present invention, a method of coating a separator with a coating solution to become a heat-resistant layer 4 will be discussed. As a coating device in accordance with an embodiment of the present invention, a device for coating a separator with a coating solution to become a heat-resistant layer 4 will be discussed.

Embodiment 1

<Configuration of Lithium Ion Secondary Battery>

A nonaqueous electrolyte secondary battery, typically, a lithium-ion secondary battery has a high energy density, and therefore, currently widely used not only as batteries for use in devices such as personal computers, mobile phones, and mobile information terminals, and for use in moving bodies such as automobiles and airplanes, but also as stationary batteries contributing to stable power supply.

Figure 1:
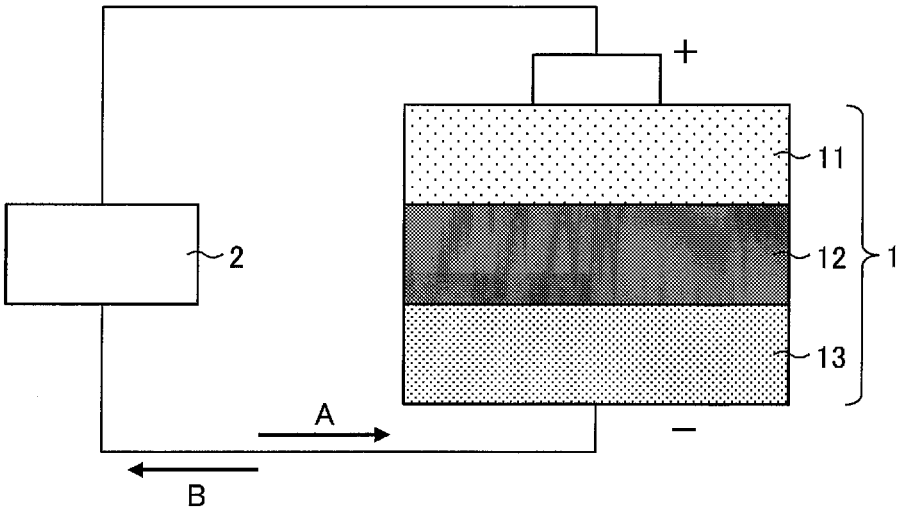
FIG. 1 is a diagram schematically illustrating a cross sectional configuration of a lithium-ion secondary battery.

FIG. 1 is a diagram schematically illustrating a cross sectional configuration of a lithium-ion secondary battery 1.

As illustrated in FIG. 1, the lithium-ion secondary battery 1 includes a cathode 11, a separator 12, and an anode 13. Between the cathode 11 and the anode 13, an external device 2 is connected outside the lithium-ion secondary battery 1. Then, while the lithium-ion secondary battery 1 is being charged, electrons move in a direction A. On the other hand, while the lithium-ion secondary battery 1 is being discharged, electrons move in a direction B.

<Separator>

The separator 12 is provided so as to be sandwiched between the cathode 11 which is a positive electrode of the lithium-ion secondary battery 1 and the anode 13 which is a negative electrode of the lithium-ion secondary battery 1. The separator 12 separates the cathode 11 and the anode 13, and allows lithium ions to move between the cathode 11 and the anode 13. Examples of a material for the separator 12 encompass polyolefin such as polyethylene or polypropylene.

Figure 2:
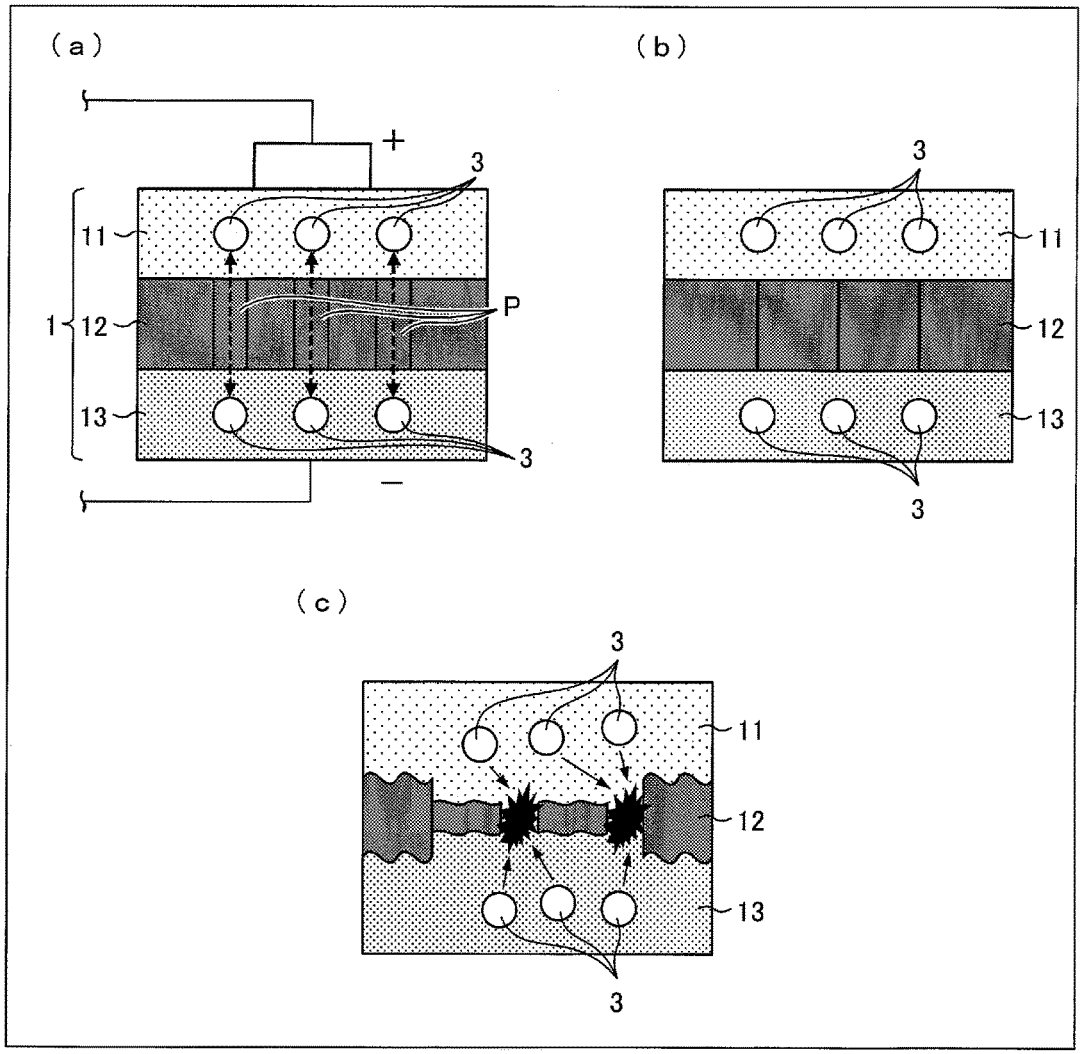
FIG. 2 is a set of views schematically illustrating respective states of the lithium-ion secondary battery illustrated in FIG. 1.

FIG. 2 is a set of views schematically illustrating respective states of the lithium-ion secondary battery 1 illustrated in FIG. 1. (a) of FIG. 2 illustrates an ordinary state. (b) of FIG. 2 illustrates a state in which a temperature of the lithium-ion secondary battery 1 has risen. (c) of FIG. 2 illustrates a state in which a temperature of the lithium-ion secondary battery 1 has sharply risen.

As illustrated in (a) of FIG. 2, the separator 12 is provided with many pores P. Ordinarily, lithium ions 3 in the lithium-ion secondary battery 1 can move back and forth through the pores P.

However, there are, for example, cases in which the temperature of the lithium-ion secondary battery 1 rises due to excessive charging of the lithium-ion secondary battery 1, a high current caused by short-circuiting of the external device, or the like. In such cases, the separator 12 melts or softens and the pores P are blocked as illustrated in (b) of FIG. 2. As a result, the separator 12 shrinks. This stops the back-and-forth movement of the lithium ions 3, and consequently stops the above temperature rise.

However, in a case where a temperature of the lithium-ion secondary battery 1 sharply rises, the separator 12 suddenly shrinks. In this case, as illustrated in (c) of FIG. 2, the separator 12 may be destroyed. Then, the lithium ions 3 leak out from the separator 12 which has been destroyed. As a result, the lithium ions 3 do not stop moving back and forth. Consequently, the temperature continues rising.

<Heat-Resistant Separator>

Figure 3:
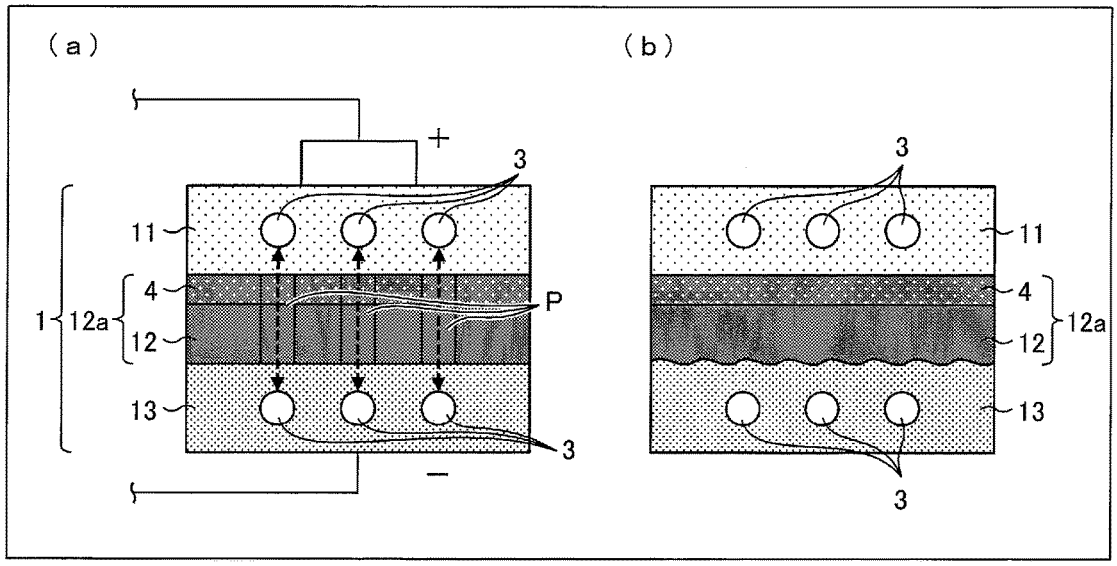
FIG. 3 is a set of views schematically illustrating respective states of a lithium ion secondary battery which is different in configuration from the lithium ion secondary battery illustrated in FIG. 2.

FIG. 3 is a set of views schematically illustrating respective states of a lithium ion secondary battery 1 which is different in configuration from the lithium ion secondary battery 1 illustrated in FIG. 2. (a) of FIG. 3 illustrates an ordinary state. (b) of FIG. 3 illustrates a state in which a temperature of the lithium-ion secondary battery 1 has sharply risen.

As illustrated in (a) of FIG. 3, the lithium ion secondary battery 1 can further include a heat-resistant layer 4. The heat-resistant layer 4 can be provided on the separator 12. (a) of FIG. 3 illustrates a configuration in which the heat-resistant layer 4 as a functional layer is provided on the separator 12. Hereinafter, a film, in which the heat-resistant layer 4 is provided on the separator 12, will be referred to as a heat-resistant separator 12*a* (functional film).

According to the configuration illustrated in (a) of FIG. 3, the heat-resistant layer 4 is laminated on a surface of the separator 12 which surface is on a cathode 11 side. Note that the heat-resistant layer 4 can alternatively be laminated on a surface of the separator 12 which surface is on an anode 13 side, or both surfaces of the separator 12. Further, the heat-resistant layer 4 is provided with pores which are similar to the pores P. Normally, the lithium ions 3 move back and forth through the pores P and the pores of the heat-resistant layer 4. The heat-resistant layer 4 contains, for example, wholly aromatic polyamide (aramid resin) as a material.

As illustrated in (b) of FIG. 3, even in a case where the temperature of the lithium-ion secondary battery 1 sharply rises and as a result, the separator 12 melts or softens, the shape of the separator 12 is maintained because the heat-resistant layer 4 supports the separator 12. Therefore, such a sharp temperature rise results in only melting or softening of the separator 12 and consequent blocking of the pores P. This stops back-and-forth movement of the lithium ions 3 and consequently stops the above-described excessive discharging or excessive charging. In this way, the separator 12 can be prevented from being destroyed.

<Heat-Resistant Separator Production Method>

The following description will discuss a heat-resistant separator production method in accordance with Embodiment 1.

A method of producing the heat-resistant separator 12*a* includes: a separator forming step of forming the separator 12; a coating step of coating a surface of the separator 12 with a coating solution to become the heat-resistant layer 4; and a drying step of drying the coating solution so that the coating solution becomes the heat-resistant layer 4. Note that after the heat-resistant layer 4 has been laminated, the heat-resistant separator 12*a* can be, as necessary, slit into slit heat-resistant separators, each of which has a narrow width such as a product width. In the coating step, the surface of the base material is uniformly coated with the coating solution through wet coating with the use of a gravure coater-based coating device.

Note that Embodiment 1 will discuss the coating step of applying a coating solution to be a heat-resistant layer 4 so that a heat-resistant separator 12*a*, in which the heat-resistant layer 4 is provided on the surface of the separator 12, is to be produced. However, the coating method in accordance with an embodiment of the present invention is not limited to such a coating step. Alternatively, the separator 12 can be provided with a functional layer other than the heat-resistant layer 4. In such a case, a coating solution corresponding to the functional layer can be applied in a coating step.

The coating solution for use in the coating method in accordance with an embodiment of the present invention includes a filler, a binder, and a solvent.

Examples of the filler encompass a filler made of organic matter and a filler made of inorganic matter. Specific examples of the filler made of organic matter encompass fillers made of (i) a homopolymer of a monomer such as styrene, vinyl ketone, acrylonitrile, methyl methacrylate, ethyl methacrylate, glycidyl methacrylate, glycidyl acrylate, or methyl acrylate, or (ii) a copolymer of two or more of such monomers; fluorine-containing resins such as polytetrafluoroethylene, ethylene tetrafluoride-propylene hexafluoride copolymer, tetrafluoroethylene-ethylene copolymer, and polyvinylidene fluoride; melamine resin; urea resin; polyethylene; polypropylene; and polyacrylic acid and polymethacrylic acid. Specific examples of the filler made of inorganic matter encompass fillers made of calcium carbonate, talc, clay, kaolin, silica, hydrotalcite, diatomaceous earth, magnesium carbonate, barium carbonate, calcium sulfate, magnesium sulfate, barium sulfate, aluminum hydroxide, boehmite, magnesium hydroxide, calcium oxide, magnesium oxide, titanium oxide, titanium nitride, alumina (aluminum oxide), aluminum nitride, mica, zeolite, or glass. The porous layer may contain (i) only one kind of filler or (ii) two or more kinds of fillers in combination.

Among the above fillers, a filler made of inorganic matter is suitable. A filler made of an inorganic oxide such as silica, calcium oxide, magnesium oxide, titanium oxide, alumina, or boehmite is preferable. A filler made of at least one kind selected from the group consisting of silica, magnesium oxide, titanium oxide, and alumina is more preferable. A filler made of alumina or boehmite is particularly preferable. While alumina has many crystal forms such as α-alumina, β-alumina, γ-alumina, and θ-alumina, any of the crystal forms can be used suitably. Among the above crystal forms, α-alumina is the most preferable because it is particularly high in thermal stability and chemical stability.

The filler has an average particle size of preferably equal to or less than 3 μm, and more preferably 1 μm. Examples of a shape of the filler encompass a spherical shape and a gourd shape. An average particle size of the filler can be calculated by, for example, (i) a method in which any 25 particles are selected by a scanning electron microscope (SEM), respective particle sizes (diameters) of the particles are measured, and an average of the 10 particle sizes is calculated or (ii) a method in which a BET specific surface area is measured, and an average particle size is calculated by spherical approximation based on the BET specific surface area. Note that, in a case where the average particle size is calculated with the use of the SEM and where particles of the filler each have a shape other than a spherical shape, a greatest length of each of the particles is designated as a particle size.

Alternatively, particles to be used can be a combination of two or more kinds which differ from each other in particle diameter and/or specific surface area.

A binder resin to be used for formation of the functional layer has a function of (i) binding together fillers by which the functional layer is constituted and (ii) binding a filler and the base film. The binder resin is preferably a resin which is (i) soluble or dispersible in a solvent to be used for a coating solution and (ii) insoluble in an electrolyte of the battery or (iii) is electrochemically stable when the battery is in normal use. The binder resin is preferably a water-dispersible polymer or a water-soluble polymer because such polymers allow an aqueous solvent to be used as a solvent of a coating solution due to a process and/or an environmental impact. Note that "aqueous solvent" means a solvent which contains water in an amount of equal to or greater than 50% by weight and which contains another solvent such as ethanol and contains an additional component provided that neither dispensability of the water-dispersible polymer nor solubility of the water-soluble polymer is impaired.

Examples of the water-dispersible polymer encompass: polyolefins such as polyethylene and polypropylene; fluorine-containing resins such as polyvinylidene fluoride and polytetrafluoroethylene; fluorine-containing rubbers such as vinylidene fluoride-hexafluoropropylene copolymer and ethylene-tetrafluoroethylene copolymer; rubbers such as styrene-butadiene copolymer and a hydrogenated one thereof, acrylic acid ester copolymer, methacrylic acid ester copolymer, acrylonitrile-acrylic acid ester copolymer, styrene-acrylic acid ester copolymer, ethylene propylene rubber, and polyvinyl acetate; and resins with a melting point or a glass transition temperature of equal to or greater than 180° C., such as polyphenylene ether, polysulfone, polyether sulfone, polyphenylene sulfide, polyetherimide, polyamide imide, polyetheramide, polyamide, and polyester.

Acrylic resins such as acrylic acid ester copolymer, methacrylic acid ester copolymer, acrylonitrile-acrylic acid ester copolymer, and styrene-acrylic acid ester copolymer are preferable because these acrylic resins are each high in property to bond fillers together or bond a filler and a base film together.

Resins with a melting point or a glass transition temperature of equal to or greater than 180° C., such as polyphenylene ether, polysulfone, polyether sulfone, polyphenylene sulfide, polyetherimide, polyamide imide, polyetheramide, and polyester are preferable because these resins have high heat resistance and cause a laminated porous film to increase in property to maintain a shape when heated. Among the heat resistant resins, polyetherimide, polyamide imide, polyetheramide, and polyamide are preferable, and polyamide is more preferable.

Examples of the water-soluble polymer encompass polyvinyl alcohol, polyethylene glycol, cellulose ether, sodium alginate, polyacrylic acid, polyacrylamide, and polymethacrylic acid. Among the water-soluble polymers, cellulose ether is preferable. Specific examples of the cellulose ether encompass carboxymethyl cellulose (CMC), hydroxyethyl cellulose (HEC), carboxy ethyl cellulose, methyl cellulose, ethyl cellulose, cyan ethyl cellulose, and oxyethyl cellulose. Among these, CMC and HEC, which have excellent chemical stability, are particularly preferable. In a case where there are salts, examples of the water-soluble polymer encompass the salts.

In a case where a nonaqueous solvent is to be used, examples of a nonaqueous solvent that can be used encompass: fluorine-containing resins such as polyvinylidene fluoride; polyvinylidene chloride; and polyacrylonitrile.

These binder resins can be used individually. Alternatively, two or more kinds of these binder resins can be used in a mixed state as necessary.

Although a ratio between a binder resin to a filler in the functional layer is to be decided as appropriate according to the purpose for the use of the functional layer, the weight ratio of the filler to the binder resin is preferably 1 to 100, and more preferably 2 to 99. In particular, in a case where the functional layer is a heat-resistant layer, the weight ratio is preferably 4 to 99.

The coating solution has a viscosity of preferably 10 Cps to 15 Cps, and more preferably 15 Cps to 30 Cps.

Figure 4:
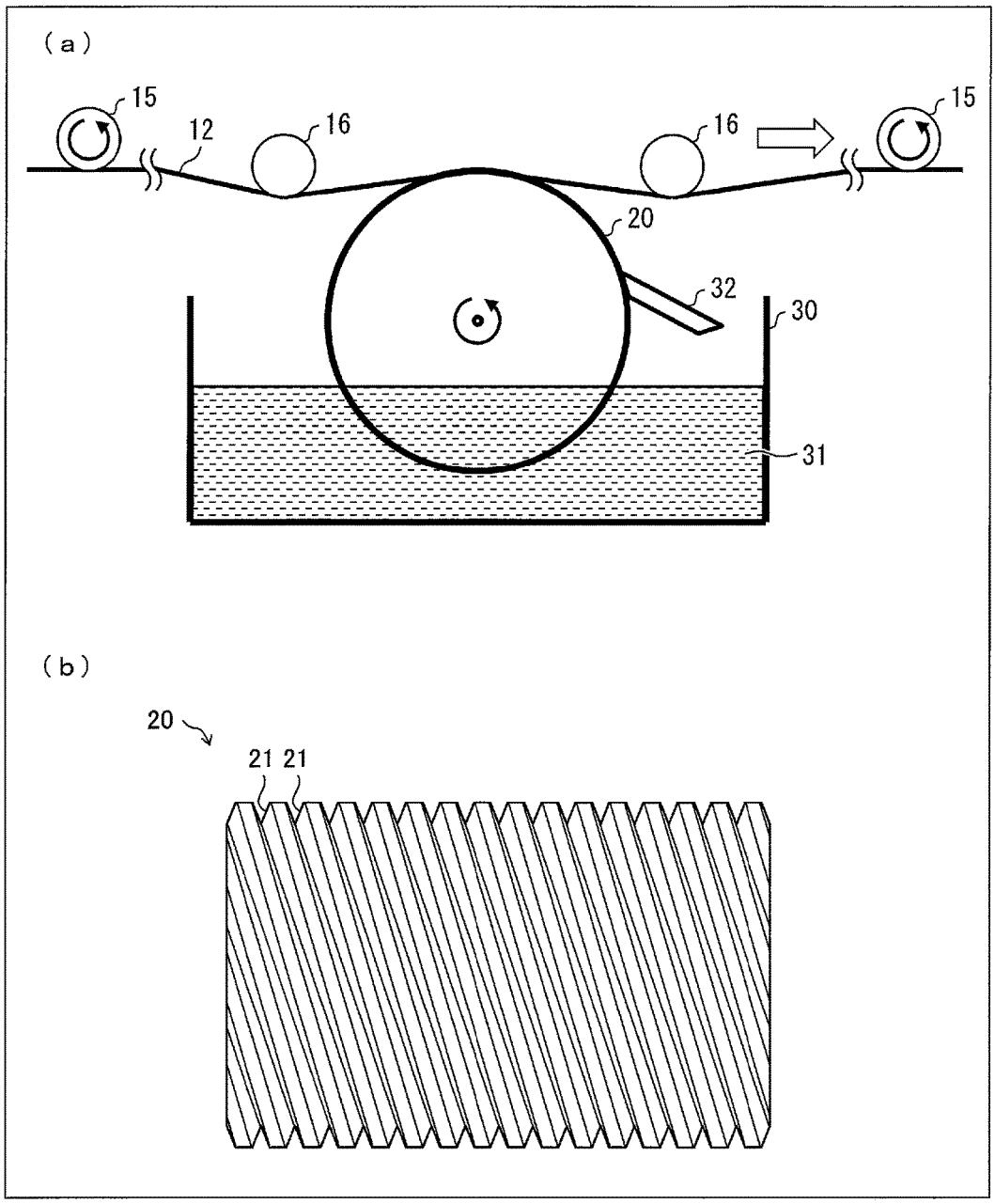
FIG. 4 is a set of views schematically illustrating a configuration of the coating device in accordance with Embodiment 1 of the present invention. (a) of FIG. 4 is a side view illustrating the configuration of the coating device. (b) of FIG. 4 is a perspective view of a gravure roll.

FIG. 4 is a set of views schematically illustrating a configuration of the coating device in accordance with Embodiment 1. (a) of FIG. 4 is a side view illustrating the configuration of the coating device. (b) of FIG. 4 is a perspective view of a gravure roll.

As illustrated in (a) of FIG. 4, the coating device includes: (i) driving rollers 15 for conveying the separator 12, (ii) a gravure roll 20 having a surface processed so as to have unevenness engraved thereon, (iii) guide rolls 16 for pressing the separator 12 against the gravure roll 20, (iv) a pan 30 for storing a coating solution 31, and (v) a doctor blade 32.

A gravure coater-based coating method is a coating method in which (i) the gravure roll 20 is immersed in the coating solution 31 so that the coating solution 31 is collected in recesses of the surface of the gravure roll 20, (ii) an excess part of the coating solution 31 on the surface of the gravure roll 20 is scraped off with the use of the doctor blade 32, and then (iii) the separator 12 serving as a base material is pressed against the gravure roll 20 with the use of the guide rolls 16, so that the coating solution collected in the recesses of the gravure roll 20 is transferred to the separator 12. Note that pressure, by which the separator 12 is pressed against the gravure roll 20, can be adjusted as appropriate by tensile force of the separator 12 and by a depth to which the guide rolls 16 presses the separator 12. The depth to which the guide rolls 16 presses the separator 12 can be, for example, 5 mm.

As illustrated in (a) of FIG. 4, the coating method, in which the coating device in accordance with Embodiment 1 is used, is a coating method carrying out such that the separator 12 being convey comes into contact with a part of a circumference of the gravure roll 20, which part is moving in a direction (reverse direction) opposite a direction in which the separator 12 is being conveyed. This coating method is known as reverse gravure coating, particularly reverse gravure kiss coating.

As illustrated in (b) of FIG. 4, it is possible to use a gravure roll 20 having a surface on which a plurality of grooves are provided so as to extend diagonally as recesses 21 for collecting the coating solution 31. The grooves are formed in a helical manner so that there is a certain angle between (i) the grooves and (ii) a center axis of a roll main body. Although the angle between the grooves and the center axis of the roll main body is 45° according to Embodiment 1, it is alternatively possible as necessary to change the angle so that it is in a range of, for example, 30° to 60°. Each of the grooves has (i) a triangular cross section, (ii) a bottom part having an angle measuring 45±15°, and (iii) a depth of 130 βm to 150 βm. The grooves are provided at pitches (spaces between bottom parts of adjacent grooves) of 100 μm to 150 μm. In a case where each of the grooves has a triangular cross section, a volume of the recesses 21 on a circumferential surface of the gravure roll 20 is determined by pitches between the grooves, by the angle of the bottom part of each groove, and by the depth of each groove. Alternatively, each of the grooves can have a trapezoidal cross section having a flat bottom part. In such a case, (i) angles between the flat part and diagonal surfaces are 110±10°, (ii) the flat part has a length of 1 μm to 80 μm, (iii) the grooves are provided at pitches (spaces between middle points of respective bottom parts of adjacent grooves) of 100 μm to 150 μm, and (iv) each of the grooves has a depth of 130 μm to 150 μm. In a case where each of the grooves has a trapezoidal cross section, a volume of the recesses 21 on a circumferential surface of the gravure roll 20 is determined by the length of the flat part of each groove, by the pitches between the grooves, by the angles between a flat part and diagonal surfaces of each groove, and by the depth of each groove.

Note that the shape of each of the recesses 21 of the gravure roll 20 is not limited to these shapes. Alternatively, it is possible to use a gravure roll having recesses 21 of various shapes.

According to the gravure coater-based coating method, a desired amount (weight per unit area) of coating solution can be applied by properly setting coating conditions such as (i) the volume of the recesses 21 of the gravure roll 20, (ii) a rotation speed of the gravure roll 20, and (iii) a diameter of the gravure roll 20.

Figure 5:
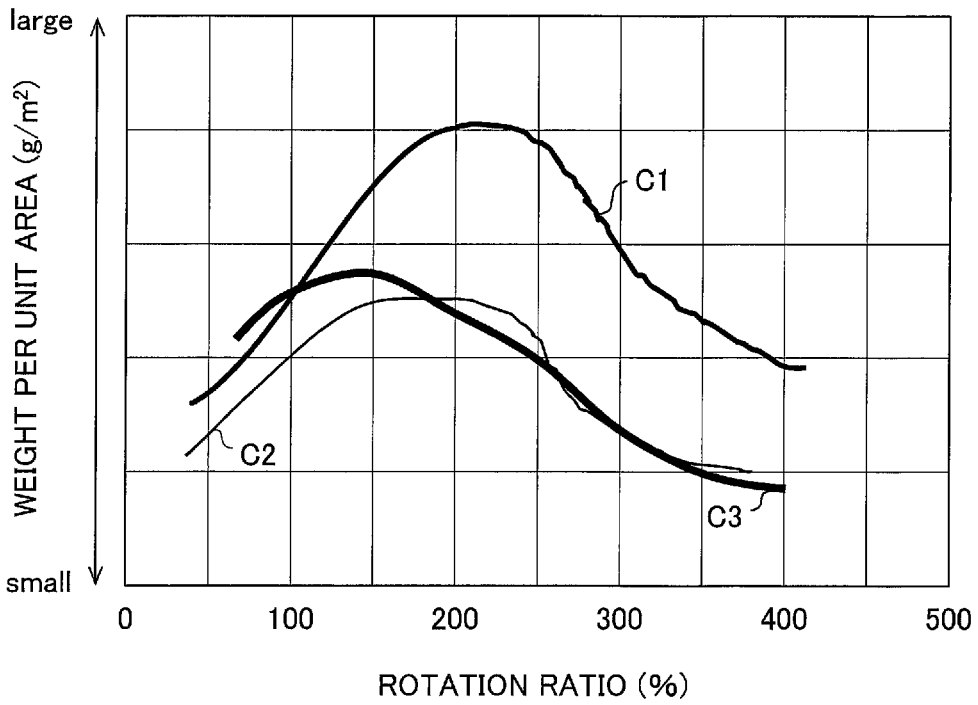
FIG. 5 is a graph showing relationships between rotation ratios and corresponding weights per unit area of a gravure roll.

FIG. 5 is a graph showing relationships between rotation ratios and corresponding weights per unit area of a gravure roll. A curve C1 in FIG. 5 is a curve showing a relationship between a rotation ratio and a weight per unit area in a case where a gravure roll having a diameter of 50 mm is used. A curve C2 in FIG. 5 is a curve showing a relationship between a rotation ratio and a weight per unit area in a case where a gravure roll having a diameter of 80 mm is used. A curve C3 is a curve showing a relationship between a rotation ratio and a weight per unit area in a case where a gravure roll having a diameter of 150 mm is used. Note that the rotation ratio (circumferential velocity ratio) of the gravure roll 20 is a ratio of a rotation speed of the gravure roll 20 to a line speed of the separator 12.

As illustrated in FIG. 5, the curves, which show relationships between the rotation ratios and the corresponding weights per unit area, each have a parabolic shape which is convex upwards. More specifically, in a case where the gravure roll 20 has a diameter of 50 mm, the weight per unit area is at a maximum value when the rotation ratio is approximately 200%. In a case where the gravure roll 20 has a diameter of 80 mm, the weight per unit area is at a maximum value when the rotation ratio is approximately 170%. In a case where the gravure roll 20 has a diameter of 150 mm, the weight per unit area is at a maximum value when the rotation ratio is approximately 150%. The coating solution can be applied with a desired weight per unit area by controlling the rotation ratio of the gravure roll 20 in accordance with the relationships between the rotation ratios and the corresponding weights per unit area shown in FIG. 5.

In a region in which a rotation ratio is equal to or less than a value at which a corresponding weight per unit area is at a maximum value, the weight per unit area linearly changes with respect to an increase in the rotation ratio, so that it is easy to control the weight per unit area. On the other hand, in a region in which a rotation ratio is greater than a value at which a corresponding weight per unit area is at a maximum value, the weight per unit area non-linearly changes with respect to an increase in the rotation ratio, so that it is difficult to control the weight per unit area. Therefore, a weight per unit area is preferably adjusted by controlling a rotation ratio in a region in which the rotation ratio is equal to or less than a value at which a corresponding weight per unit area is at a maximum value.

Under general coating conditions under which coating has been conventionally carried out, weight per unit area is non-uniform in some cases. This may result in a non-uniform thickness of a heat-resistant layer 4 of a heat-resistant separator to be produced, so that, in some cases, a heat-resistant layer 4 may have a defective appearance.

FIG. 6 is a set of views each illustrating a state of a surface of a heat-resistant layer of a heat-resistant separator. (a) of FIG. 6 is a photograph showing a surface of a heat-resistant layer in a case where the surface has been coated at a rotation ratio of 70% with the use of a gravure roll having a diameter of 150 mm. (b) of FIG. 6 is a photograph showing a surface of a heat-resistant layer in a case where the surface has been coated at a rotation ratio of 70% with the use of a gravure roll having a diameter of 50 mm.

As illustrated in (b) of FIG. 6, in a case where coating is carried out at a rotation ratio of 70% with the use of a gravure roll having a diameter of 50 mm, a coating solution can be applied uniformly, so that the state of a surface of a heat-resistant layer 4 after drying is excellent. Meanwhile, as illustrated in (a) of FIG. 6, in a case where coating is carried out at a at a rotation ratio of 70% with the use of a gravure roll having a diameter of 150 mm, an uneven form appears on a surface of a heat-resistant layer 4 after drying. The uneven form of the surface of the heat-resistant layer 4 is considered to have been made by a form of grooves on a surface of a gravure roll 20 being transferred to the surface of the heat-resistant layer 4, and is considered to have resulted from the presence of, due to the form of the grooves on the surface of the gravure roll 20, parts where coating was carried out in an large amount and parts where coating was carried out in a small amount.

The heat-resistant separator production method in accordance with Embodiment 1 includes a coating step in which (i) a coating solution is uniformly applied, so that a heat-resistant layer 4 after drying has an excellent appearance and (ii) the coating solution is applied under coating conditions for enhancing uniformity in thickness of the heat-resistant layer 4. The heat-resistant separator production method will be described in detail below.

EXAMPLES (Separator Forming Step)

To a total amount of 100 parts by weight consisting of 70% by weight of ultra-high molecular weight polyethylene powder (340M, manufactured by Mitsui Chemicals, Inc.) and 30% by weight of polyethylene wax (FNP-0115, manufactured by Nippon Seiro Co., Ltd.) having a weight-average molecular weight of 1000, 0.4% by weight of antioxidant (Irg1010, manufactured by Ciba Specialty Chemicals Inc.), 0.1% by weight of antioxidant (P168, manufactured by Ciba Specialty Chemicals Inc.), and 1.3% by weight of sodium stearate were added. Then, a calcium carbonate (manufactured by Maruo Calcium Co., Ltd.) having an average pore diameter of 0.1 μm was added in an amount of 38% by volume relative to a total volume. Then, a resultant powder was mixed with the use of a Henschel mixer. Then, a resultant mixture was molten and kneaded with the use of a biaxial kneader, so that a polyolefin resin composition was obtained.

The polyolefin resin composition was rolled with the use of a pair of rolls each having a surface temperature of 150° C., so that a sheet was obtained. The sheet was immersed in a hydrochloric acid aqueous solution (4 mol/L of hydrochloric acid, 0.5% by weight of nonionic surfactant), so that a calcium carbonate was removed. Then, a resultant sheet was stretched widthwise. This resulted in a separator which had (i) a thickness of 18.2 μm, (ii) a weight per unit area (mass per unit area) of 7.2 g/m$^2$, and an air permeability of 89 seconds/100 ml.

(Coating Step)

(1) Preparation of Coating Solution

A coating solution was produced by the following steps. First, a CMC solution (CMC concentration: 0.70% by weight relative to CMC solution) as a medium was obtained by dissolving carboxymethyl cellulose (CMC, Cellogen 3H manufactured by Dai-ichi Kogyo Seiyaku Co., Ltd.) in 5% by weight of isopropyl alcohol aqueous solution.

Then, 3500 parts by weight of alumina (AKP3000, manufactured by Sumitomo Chemical Co., Ltd.) relative to 100 parts by weight of the CMC solution as calculated based on CMC was added and mixed. Then, a resultant mixture was processed three times under high-pressure dispersion conditions (60 MPa) with the use of a galling homogenizer, so that a coating solution was prepared. Viscosity of the coating solution measured with the use of a B-type viscometer under conditions of 100 rpm and 23° C. was 20 cP.

(2) Coating Conditions

The following description will discuss, in detail, Examples 1 through 10 and Comparative Examples 1 through 3 as examples of the coating conditions. (a) of FIG. 7 shows a list of coating conditions in Examples 1 through 10 and Comparative Examples 1 through 3.

Example 1

As coating conditions of Example 1, (i) a gravure roll 20 having a diameter of 50 mm and having recesses 21 whose volume per unit area was 100 mL/m$^2$ was used, (ii) a line speed (conveyance speed) of a separator 12 was set to 30 m/min, and (iii) a rotation ratio was set to 60%.

Example 2

As coating conditions of Example 2, (i) a gravure roll 20 having a diameter of 50 mm and having recesses 21 whose volume per unit area was 100 mL/m$^2$ was used, (ii) a line speed (conveyance speed) of a separator 12 was set to 30 m/min, and (iii) a rotation ratio was set to 80%.

Example 3

As coating conditions of Example 3, (i) a gravure roll 20 having a diameter of 50 mm and having recesses 21 whose volume per unit area was 100 mL/m$^2$ was used, (ii) a line speed (conveyance speed) of a separator 12 was set to 30 m/min, and (iii) a rotation ratio was set to 150%.

Example 4

As coating conditions of Example 4, (i) a gravure roll 20 having a diameter of 80 mm and having recesses 21 whose volume per unit area was 60 mL/m$^2$ was used, (ii) a line speed (conveyance speed) of a separator 12 was set to 60 m/min, and (iii) a rotation ratio was set to 80%.

Example 5

As coating conditions of Example 5, (i) a gravure roll 20 having a diameter of 80 mm and having recesses 21 whose volume per unit area was 60 mL/m$^2$ was used, (ii) a line speed (conveyance speed) of a separator 12 was set to 60 m/min, and (iii) a rotation ratio was set to 100%.

Example 6

As coating conditions of Example 6, (i) a gravure roll 20 having a diameter of 80 mm and having recesses 21 whose volume per unit area was 60 mL/m$^2$ was used, (ii) a line speed (conveyance speed) of a separator 12 was set to 60 m/min, and (iii) a rotation ratio was set to 150%.

Example 7

As coating conditions of Example 7, (i) a gravure roll 20 having a diameter of 150 mm and having recesses 21 whose volume per unit area was 60 mL/m$^2$ was used, (ii) a line speed (conveyance speed) of a separator 12 was set to 30 m/min, and (iii) a rotation ratio was set to 100%.

Example 8

As coating conditions of Example 8, (i) a gravure roll 20 having a diameter of 150 mm and having recesses 21 whose volume per unit area was 60 mL/m$^2$ was used, (ii) a line speed (conveyance speed) of a separator 12 was set to 30 m/min, and (iii) a rotation ratio was set to 120%.

Example 9

As coating conditions of Example 9, (i) a gravure roll 20 having a diameter of 150 mm and having recesses 21 whose volume per unit area was 30 mL/m$^2$ was used, (ii) a line speed (conveyance speed) of a separator 12 was set to 30 m/min, and (iii) a rotation ratio was set to 200%.

Example 10

As coating conditions of Example 10, (i) a gravure roll 20 having a diameter of 150 mm and having recesses 21 whose volume per unit area was 60 mL/m$^2$ was used, (ii) a line speed (conveyance speed) of a separator 12 was set to 30 m/min, and (iii) a rotation ratio was set to 250%.

Comparative Example 1

As coating conditions of Comparative Example 1, (i) a gravure roll 20 having a diameter of 50 mm and having recesses 21 whose volume per unit area was 100 mL/m$^2$ was used, (ii) a line speed (conveyance speed) of a separator 12 was set to 30 m/min, and (iii) a rotation ratio was set to 40%.

Comparative Example 2

As coating conditions of Comparative Example 2, (i) a gravure roll 20 having a diameter of 150 mm and having recesses 21 whose volume per unit area was 60 mL/m$^2$ was used, (ii) a line speed (conveyance speed) of a separator 12 was set to 30 m/min, and (iii) a rotation ratio was set to 80%.

Comparative Example 3

As coating conditions of Comparative Example 3, (i) a gravure roll 20 having a diameter of 80 mm and having recesses 21 whose volume per unit area was 100 mL/m$^2$ was used, (ii) a line speed (conveyance speed) of a separator 12 was set to 30 m/min, and (iii) a rotation ratio was set to 70%.

<Results of Evaluation of Coating>

(a) of FIG. 7 is a table showing (i) coating conditions of Examples 1 through 10 and Comparative Examples 1 through 3 under which the production method was carried out and (ii) corresponding states of appearances of heat-resistant separators obtained. (b) of FIG. 7 is a table showing weights per unit area of heat-resistant layers 4 of the heat-resistant separators obtained in Examples 4 through 6, Examples 9 through 10, and Comparative Examples 1 through 3 under which the production method was carried out. (a) of FIG. 7 also shows indexes A, each of which is a value obtained through dividing, by a rotation ratio, a product of (i) a diameter of a gravure roll (roll diameter) and (ii) a volume of recesses 21 per unit area of the gravure roll.

Specifically, an index A can be represented by the following Formula (1):

$$A = a \times c / b \qquad \text{Formula (1)}$$

where (i) a is a diameter (mm) of a gravure roll, (ii) b is a rotation ratio (%) of the gravure roll, and (iii) c is a volume (mL/m$^2$) of recesses 21 per unit area of the gravure roll.

Appearance scores shown in (a) of FIG. 7 are each a numerical value into which results of evaluation of an appearance of a heat-resistant separator 12*a* by visual observation and microscopic observation were converted, the heat-resistant separator 12*a* being produced through (i) carrying out coating under coating conditions of a corresponding one of Examples and Comparative Examples and (ii) a drying step. Specifically, the appearance score was "0" in a case where a separator 12 serving as a base material was exposed, so as to be useless as a heat-resistant separator 12*a* for a battery. The appearance score was "1" in a case where a stripe pattern was formed on a surface of a heat-resistant layer 4. The appearance score was "2" in a case where there was no stripe pattern formed, so that an appearance was excellent.

A weight per unit area (Za) of a heat-resistant layer 4 of a heat-resistant separator, which weight per unit area (Za) is shown in the table of (b) of FIG. 7, was calculated as follows. First, part of a separator 12 before coating was cut into a square measuring 10 cm×10 cm, and then a mass (Xa) per unit area of the separator 12 was calculated. Then, part of a heat-resistant separator 12*a* obtained through a coating step and a drying step was cut into a square measuring 10 cm×10 cm, and a mass (Xb) per unit area of the heat-resistant separator 12*a* was calculated. Then, a weight per unit area (Za) of a heat-resistant layer 4 was calculated by subtracting the mass (Xa) per unit area of the separator 12 from the mass (Xb) per unit area of the heat-resistant separator 12*a*. Three heat-resistant separators 12*a* were produced under each of the coating conditions of Examples 4 through 6, Examples 9 through 10, and Comparative Examples 1 through 3. Then, for each of the three heat-resistant separators 12*a*, weights per unit area (weight per unit area 1 through weight per unit area 3) of a heat-resistant layer 4 and respective standard deviations of the weight per unit area 1 through the weight per unit area 3 were calculated.

As coating conditions of Example 4, coating was carried out while adjusting the rotation ratio of the gravure roll so that the weight per unit area was 5.5 g/m$^2$. As coating conditions of Example 5, coating was carried out while adjusting the rotation ratio of the gravure roll so that the weight per unit area was 7.2 g/m$^2$. As coating conditions of Example 6, coating was carried out while adjusting the rotation ratio of the gravure roll so that the weight per unit area was 7.6 g/m$^2$. As coating conditions of Example 9, coating was carried out while adjusting the rotation ratio of the gravure roll so that the weight per unit area was 2.5 g/m$^2$. As coating conditions of Example 10, coating was carried out while adjusting the rotation ratio of the gravure roll so that the weight per unit area was 5.5 g/m$^2$.

<Preferable Coating Conditions>

(Appearance)

Figure 8:
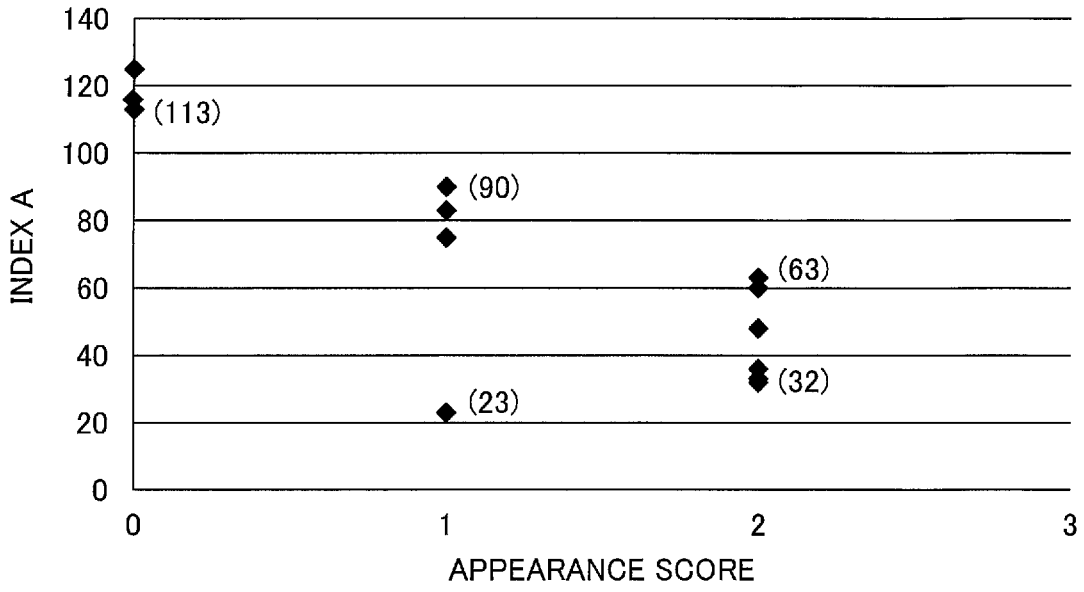
FIG. 8 is a graph showing relationships between an index A and each corresponding one of the appearance scores of the heat-resistant separators produced by the production methods including the respective coating steps under the coating conditions of Examples and Comparative Examples.

FIG. 8 is a graph showing relationships between an index A and each corresponding one of the appearance scores of the heat-resistant separators produced by the production methods including the respective coating steps under the coating conditions of Examples and Comparative Examples.

Figure 9:
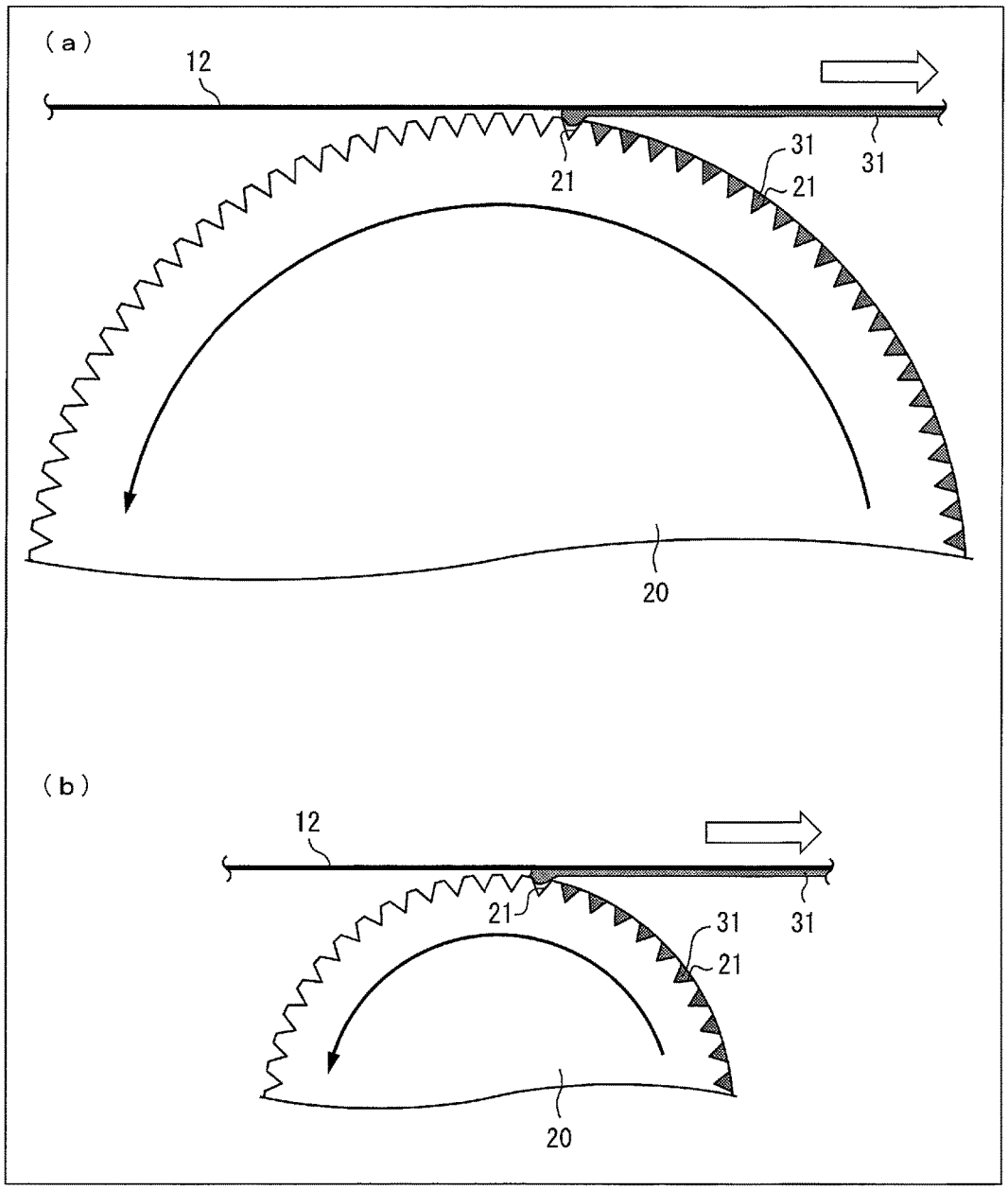
FIG. 9 is a set of views (a) and (b). (a) of FIG. 9 illustrates a part at which a gravure roll having a diameter of 150 mm is in contact with a separator. (b) of FIG. 9 illustrates a part at which a gravure roll having a diameter of 50 mm is in contact with a separator.

FIG. 9 is a set of enlarged views each illustrating a part at which a gravure roll and a separator are in contact with each other. (a) of FIG. 9 illustrates a part at which a gravure roll having a diameter of 150 mm is in contact with a separator. (b) of FIG. 9 illustrates a part at which a gravure roll having a diameter of 50 mm is in contact with a separator.

As illustrated in FIG. 9, a coating solution 31 collected in recesses 21 of a gravure roll 20 is stuck on a separator 12 by surface tension, and is then made uniform and flat by protrusions that constitute the recesses 21 in which the coating solution 31 was collected.

Note that a rotation ratio b (%) of the gravure roll 20 can be represented by the following Formula (2):

$$b=0.001\times a\times\pi\times B/d \qquad \text{Formula (2)}$$

where (i) d is a conveyance speed (line speed) (m/min) of the separator 12 and (ii) B is a rotation speed (rpm) of the gravure roll 20.

The index A can be represented by the following Formula (3) based on the Formula (1) and the Formula (2):

$$A=(c\times d)/(0.001\times B\times\pi) \qquad \text{Formula (3)}$$

According to the Formula (3), a higher rotation speed B of the gravure roll 20, a slower line speed d, and a smaller volume c of the gravure roll result in a smaller index A. In addition, the index A is directly proportional to a value (c/B) obtained by dividing the line speed d (m/min) by the rotation speed B (rpm) of the gravure roll 20. This is considered to be due to the following factor: In a case where the line speed (m/min) is high with respect to the rotation speed (rpm) of the gravure roll 20 and where the amount of coating solution 31 per unit area of the gravure roll 20 is large, the coating solution 31, which has been released from the recesses 21 by surface tension and has been stuck on the separator 12, is separated from the gravure roll 20 while, without being made uniform by the protrusions, maintaining its shape corresponding to the shape of the recesses 21. Therefore, in order to prevent the shape of the grooves of the gravure roll from being transferred, it is preferable to cause the coating solution 31, which is stuck on the separator 12, to be made uniform so as to be more flat. In order to make the coating solution 31 uniform in such a way, it is preferable to set coating conditions under which an index A becomes small.

As illustrated in FIG. 8, the appearance score was 0 in a case where the index A was equal to or greater than 113. Therefore, the coating step is preferably carried out under coating conditions under which the index A is greater than 0 and less than 113 ($0<A<113$). This allows a heat-resistant layer 4 to be formed while allowing the entire surface of the separator 12 to be uniformly coated with a coating solution without exposing the separator 12.

The appearance score was equal to or greater than 1 in a case where the index A was equal to or less than 90. Therefore, the coating step is preferably carried out under coating conditions under which the index A is equal to or less than 90 ($A\leq 90$). This allows a heat-resistant layer 4 to be formed while allowing the entire surface of the separator 12 to be more uniformly coated with a coating solution.

The appearance score was 2 in a case where the index A was equal to or greater than 32 and equal to or less than 63. Therefore, the coating step is preferably carried out under coating conditions under which the index A is equal to or greater than 32 and equal to or less than 63 ($32\leq A\leq 60$). This allows a heat-resistant layer 4 to be formed while allowing a coating solution to be uniformly applied without causing a stripe pattern, which corresponds to the shape of the recesses 21 of the gravure roll 20, to be generated.

As illustrated in (b) of FIG. 7, standard deviations of weights per unit area of heat-resistant layers 4 obtained by coating under the coating conditions of Examples 9 and 10 are larger than standard deviations of weights per unit area of heat-resistant layers 4 obtained by coating under the coating conditions of Examples 4 through 6. This is because the rotation ratio under the coating conditions of Example 9 and the rotation ratio under the coating conditions of Example 10 are 200% and 250%, respectively, which are both greater than a preferable range of a rotation ratio described with reference to FIG. 5, so that controllability of the weights per unit area was reduced.

(Relationship Between Conveyance Speed and Index A)

In a case where conveyance tension is excessively small in the coating step in which the separator 12 is coated while being conveyed, the separator 12 becomes wrinkled. In a case where conveyance tension is excessively large in the coating step, there is a risk of tearing the separator 12.

Therefore, in order to coat a film while conveying the film at a proper conveyance tension, a conveyance speed (line speed) in the coating step is preferably set to a speed falling within a range of approximately 20 m/min to 60 m/min. A rotation speed, a diameter, and a volume of a gravure roll are set according to the line speed, and will be described in detail below.

(Rotation Speed)

As described above with reference to FIG. 5, in view of controllability of a weight per unit area, a rotation ratio is preferably controlled in a region in which a rotation ratio is equal to or less than a value at which a corresponding weight per unit area is at a maximum value.

In order to adjust a weight per unit area in a region in which the weight per unit area particularly linearly changes with respect to an increase in a rotation ratio, the rotation ratio is preferably equal to or less than 150%, and particularly preferably equal to or less than 120%. If the rotation ratio is set to an excessively small value, then not an entire surface of a separator being conveyed can be uniformly coated. Therefore, in order to uniformly apply a coating solution, the rotation ratio is preferably equal to or greater than 40%, and particularly preferably equal to or greater than 60%.

The rotation ratio is preferably set to fall within the above ranges by adjusting the rotation speed of the gravure roll 20 according to a line speed.

(Roll Diameter)

The diameter of the gravure roll 20 can be set as appropriate. Note, however, that in order to carrying out coating at a desired rotation ratio, the gravure roll 20 needs to be (i) rotated faster if the diameter of the gravure roll 20 is smaller and (ii) rotated slower if the diameter of the gravure roll 20 is larger.

However, in a case where the rotation speed of the gravure roll 20 is set to an excessively high value or to an excessively small value, a weight per unit area becomes less stable. Therefore, the diameter of the gravure roll 20 is preferably equal to or greater than 20 mm and equal to or less than 180 mm, and particularly preferably equal to or greater than 30 mm and equal to or less than 150 mm.

(Volume)

The volume of the recesses 21 of the gravure roll 20 can be set as appropriate. Note, however, that in a case where the volume is set to an excessively small value, the gravure roll 20 needs to be rotated fast in order for coating to be carried out with a desired weight per unit area. In a case where the volume is set to a large value, there is a risk of impairing the uniformity of the weight per unit area.

Therefore, the volume of a gravure roll is equal to or greater than 10 $mL/m^2$, preferably equal to or less than 120 $mL/m^2$, more preferably equal to or greater than 20 $mL/m^2$ and equal to or less than 100 $mL/m^2$, and particularly preferably equal to or greater than 60 $mL/m^2$.

It is possible to form a heat-resistant layer 4 by uniformly coating the entire surface of the separator 12 with a coating solution through selecting proper coating conditions under which the index A falls within the above-described numerical range based on preferable numerical ranges of the rotation ratio, the diameter, and the volume of the gravure roll 20.

In order to carry out coating while conveying the film at a proper conveyance tension, as described above, (i) the rotation ratio is particularly preferably equal to or less than 120%, (ii) the diameter of the gravure roll 20 is particularly preferably equal to or greater than 30 mm, and (iii) the volume of the recesses 21 of the gravure roll 20 is particularly preferably equal to or greater than 60 $mL/m^2$. Therefore, the index A is particularly preferably equal to or greater than 15.

SUMMARY

A coating method in accordance with an embodiment of the present invention is a reverse gravure coating method of coating a film by use of a gravure roll, in which the following formula is satisfied:

$$0<a\times c/b<113$$

where (i) a is a diameter (mm) of the gravure roll, (ii) b is a ratio of a circumferential velocity of the gravure roll to a conveyance speed at which the film is conveyed, and (iii) c is a volume ($mL/m^2$) of recesses of the gravure roll, which volume is measured per unit area of a circumferential surface of the gravure roll (hereinafter, "b" may be referred to as "rotation ratio").

With the method, an entire surface of the film can be uniformly coated with a coating solution without exposing the film.

The coating method is preferably configured so that the following formula is satisfied:

$$a\times c/b\leq 90.$$

This more reliably allows the entire surface of the film to be uniformly coated with a coating solution without exposing the film.

The coating method is preferably configured so that the following formula is satisfied:

$$15\leq a\times c/b.$$

This allows the entire surface of the film to be uniformly coated with a coating solution while conveying the film at a proper conveyance tension without exposing the film.

The coating method is preferably configured so that the following formula is satisfied:

$$32\leq a\times c/b\leq 63.$$

This allows a coating solution to be applied without causing a pattern, which corresponds to the shape of the recesses of the gravure roll, to be generated.

The coating method can be configured so that a surface of the gravure roll is provided with a plurality of grooves constituting the recesses.

The coating method is preferably configured so that the following formula is satisfied:

$$20\leq a\leq 180.$$

A coating device in accordance with an embodiment of the present invention includes: a gravure roll which rotates in a reverse direction which is opposite a direction in which a film is conveyed, the following formula being satisfied:

$$0<a\times c/b<113$$

where (i) a is a diameter (mm) of the gravure roll, (ii) b is a ratio of a circumferential velocity of the gravure roll to a conveyance speed at which the film is conveyed, and (iii) c is a volume ($mL/m^2$) of recesses of the gravure roll, which volume is measured per unit area of a circumferential surface of the gravure roll.

In order to attain the object, a functional film production method in accordance with an embodiment of the present invention is configured so that the above coating method is used.

[Additional Remarks]

The present invention is not limited to the description of the embodiments, but can be altered in many ways by a person skilled in the art within the scope of the claims. An embodiment derived from a proper combination of technical means disclosed in different embodiments is also encompassed in the technical scope of the present invention.

REFERENCE SIGNS LIST

4 Heat-resistant layer
12 Separator (film)
12*a* Heat-resistant separator (functional film)
20 Gravure roll
21 Recess
31 Coating solution

The invention claimed is:

1. A reverse gravure coating method of coating a battery separator comprising transferring a coating solution from a gravure roll to the battery separator, wherein the following formula is satisfied:

$$0<a\times c/b<113$$

where (i) a is a diameter (mm) of the gravure roll, (ii) b is a ratio on a % basis of a circumferential velocity of the gravure roll to a conveyance speed, d (m/min), at which the battery separator is conveyed, wherein the following formula is satisfied:

$$b=0.001\times a\times\pi\times B/d$$

Where B (rpm) is a rotational speed of the gravure roll, and (iii) c is a volume ($mL/m^2$) of recesses of the gravure roll, which volume is measured per unit area of a circumferential surface of the gravure roll;

wherein $10\ mL/m^2 \leq c \leq 120\ mL/m^2$.

2. The method as set forth in claim 1, wherein the following formula is satisfied:

$$a\times c/b\leq 90.$$

3. The method as set forth in claim 1, wherein the following formula is satisfied:

$$15\leq a\times c/b.$$

4. The method as set forth in claim 1, wherein the following formula is satisfied:

$$32\leq a\times c/b\leq 63.$$

5. The method as set forth in claim 1, wherein a surface of the gravure roll is provided with a plurality of grooves constituting the recesses.

6. The method as set forth in claim 1, wherein the following formula is satisfied:

$$20\leq a\leq 180.$$

7. A method of producing a heat-resistant battery separator, comprising coating a battery separator with a coating solution to form a heat-resistant layer on the separator, wherein the coating is performed by the reverse gravure coating method recited in claim 1.

* * * * *